United States Patent [19]

Takakuwa

[11] Patent Number: 4,463,232

[45] Date of Patent: Jul. 31, 1984

[54] MEMBRANE SWITCH HAVING SPACER POSTS

[75] Inventor: Masao Takakuwa, Sayama, Japan

[73] Assignee: Toho- Polymer Kabushiki Kaisha, Tokyo, Japan

[21] Appl. No.: 387,020

[22] Filed: Jun. 10, 1982

[51] Int. Cl.[3] ..... H01H 13/70

[52] U.S. Cl. ..... 200/159 B

[58] Field of Search ..... 200/5 A, 159 B, 86.5, 200/86 R

[56] References Cited

U.S. PATENT DOCUMENTS

| | | | |
|---|---|---|---|
| 3,600,528 | 8/1971 | Leposavic | 200/5 A |
| 3,668,337 | 6/1972 | Sinclair | 200/86.5 X |
| 3,721,778 | 3/1973 | Seeger, Jr. et al. | 200/5 A X |
| 3,911,215 | 10/1975 | Hurst et al. | 200/86 R X |
| 3,932,722 | 1/1976 | Obata et al. | 200/5 A X |
| 3,941,953 | 3/1976 | Misson et al. | 200/5 A X |
| 4,034,176 | 7/1977 | Larson | 200/5 A |
| 4,145,584 | 3/1979 | Otterlei | 200/5 A |
| 4,220,815 | 9/1980 | Gibson et al. | 200/86 R X |
| 4,302,648 | 11/1981 | Sado et al. | 200/5 A |
| 4,382,165 | 5/1983 | Balash et al. | 200/5 A |

FOREIGN PATENT DOCUMENTS

| | | | |
|---|---|---|---|
| 3033134 | 5/1981 | Fed. Rep. of Germany | 200/159 B |

*Primary Examiner*—J. R. Scott

*Attorney, Agent, or Firm*—Edward F. Levy

[57] ABSTRACT

Disclosed is a pushbutton-type switch such as used on the keyboard of a small-size electronic computer. The switch includes a main member carrying a movable contact and one or more projections or posts of lesser height than the movable contact. Upon application of finger pressure to the main member, the movable contact is brought into uniform contact with a fixed contact therebelow without chattering, by virtue of the supporting action of the posts.

5 Claims, 4 Drawing Figures

PRIOR ART

MEMBRANE SWITCH HAVING SPACER POSTS

BACKGROUND OF THE INVENTION

This invention relates to an improvement in a pushbutton switch for use on an electronic apparatus or the like.

In a keyboard of a small size-electronic computer, for example, a push button switch having a movable contact is mounted on a printed circuit board or substrate having a fixed contact. When the push-button switch is depressed by the operator's finger pressure, the movable contact is brought into contact with the fixed contact to close the electrical circuit connected to the fixed contact. The pushbutton switch shown in FIG. 1 is used for such purpose. In FIG. 1, reference numeral 1 denotes a main member of the pushbutton switch. Reference numerals 2, 3 denote a pushbutton portion and a skirt portion of the main member 1, respectively. The pushbutton 2 and the skirt portion 3 consist of an insulating resilient material such as rubber and are formed integrally with each other, as may be seen from the drawing.

A movable contact 4 made of resilient conducting material is secured on a printed circuit board or substrate 5 below the pushbutton portion 2. A fixed contact 6 is provided on the substrate and forms a portion of a circuit pattern, not shown, of the substrate 5. In the above construction of the pushbutton switch, when finger pressure is applied to the push button portion 2 of the main member 1, the pushbutton portion 2 is deformed at an upstanding wall thereof so that the movable contact 4 is brought into contact with the fixed contact 6 to close the electrical circuit wire to contact 6. However, the prior-art pushbutton switch has the following defect. Assume that the movable contact 4 has been contacted with the fixed contact by a finger placed on the pushbutton portion 2. If the finger pressure is applied slightly off-center as indicated by the arrow mark in FIG. 2, the contact 4 tends to tilt because of the resilient properties of the main member 1 of the pushbutton switch. Thus there is a tendency for the current flowing through the contacts to be interrupted because of a poor electrical connection. If the finger pressure acts on the pushbutton portion 2 diagonally, the latter is deformed transversely and causes both transverse and oblique displacement of the movable contact 4, so that the movable contact will be brought into only partial contact with the fixed contact 6, again resulting in an insufficient electrical connection. The foregoing phenomena causing displacement or tilting of the movable contact 4 with respect to the fixed contact 6 also occur when the finger is placed not at the center but at the periphery of the pushbutton portion 2.

In addition, the prior-art pushbutton switch may be deformed or leveled in a skewed manner depending on the direction in which finger pressure is exerted upon the pushbutton portion. Hence, the switch may catch on a guide member which receives the pushbutton switch and may not close the contacts despite sustained finger pressure. The likely result would be an input error.

SUMMARY OF THE INVENTION

In view of the foregoing disadvantages of the prior-art device, it is a primary object of the present invention to provide a pushbutton switch in which contact support posts are provided for preventing the tilting of the movable contact even in cases where the pushbutton portion is not pressed vertically and substantially at the center, and for assuring optimum contact of the movable and fixed contacts with a sufficient contact area.

It is another object of the present invention to provide a pushbutton switch in which contact chattering may be prevented to assure stable contact signals even in cases where the pushbutton portion is pressed obliquely and at an off-center position.

It is another object of the present invention to provide a pushbutton switch in which contacts of predetermined surface areas are disposed in vertical alignment with each other for enlarging the contact area and reducing the electrical resistance between the contacts to eliminate poor electrical connection.

It is yet another object of the present invention to provide a pushbutton switch in which tilting of the movable contact may be eliminated so that the switch will not catch on the housing or on a guide member for the switch or on other mechanical components, and in which input errors may be avoided by assuring optimum electrical contact.

According to the present invention, the foregoing and other objects are attained by providing, in a pushbutton switch in which a movable contact carried on a deformable support member may be contacted with or separated from an opposing fixed contact for closure or opening of the contacts, one or more contact support members acting between the contacts in such a manner that good electrical connection between the movable and fixed contacts is not inhibited. The contact support members are provided on the support member and are directed towards the fixed contact, and are of a lower height than the movable contact. In a preferred embodiment, a contact support member is provided on both sides of the movable contact and at a predetermined distance from the movable contact. In another embodiment, three or more contact support members are provided around and at predetermined distances from the movable contact. The contact support members are made of a resilient material having a high coefficient of friction, and are formed as projections or posts.

Other features and advantages of the present invention will be apparent from the following description taken in conjunction with the accompanying drawings in which like reference characters designate the same or similar parts throughout the figures thereof.

DESCRIPTION OF PREFERRED EMBODIMENTS

Figure 1:
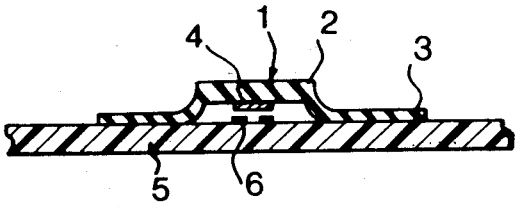
FIG.1 PRIOR ART
FIG. 1 is a sectional view of a conventional pushbutton switch.
Figure 2:
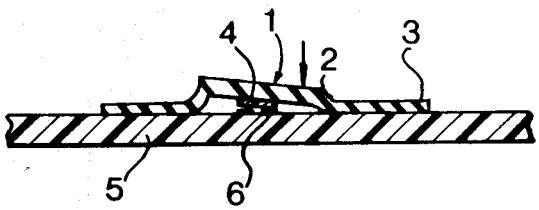
FIG.2 PRIOR ART
FIG. 2 is a sectional view similar to FIG. 1 and showing a movable contact in skewed contact with the fixed contact under finger pressure off-center of the movable contact.
Figure 3:
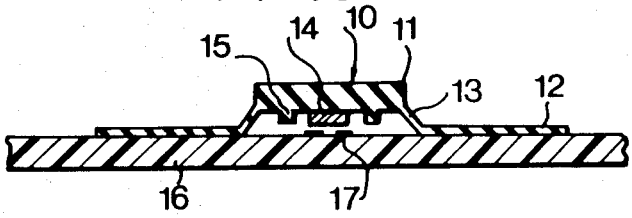
FIG. 3 is a sectional view of a push button switch according to a preferred embodiment of the present invention.
Figure 4:
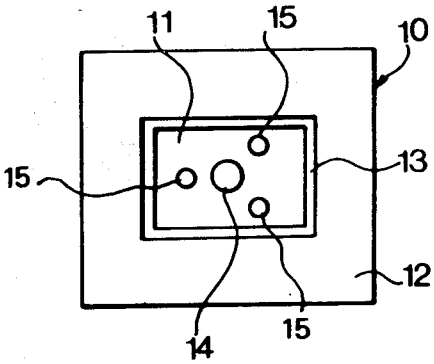
FIG. 4 is a bottom view of a pushbutton switch according to a modification.

Reference is made to the accompanying drawings illustrating certain preferred embodiments of the present invention. In FIG. 3, reference numeral 10 denotes a main member of the pushbutton switch which is formed integrally of a pushbutton portion 11 and a skirt portion 12, from a resilient insulating material such as rubber. The portions 11, 12 are connected together by a connecting portion 13 of reduced thickness to permit the deformation of the main member 10 thereat. Reference numeral 14 denotes a movable contact of a resilient conducting member mounted at substantially the center of the underside of the pushbutton portion 11, and reference numeral 15 denotes projections or posts mounted in the neighborhood of the movable contact 14. These posts 15 are of slightly lesser height than the movable contact 14 and preferably formed of a material having a high coefficient of friction, such as rubber. The posts 15 may be formed integrally with the pushbutton portion of the main member 10 of the switch to assure sufficient mechanical strength. In the embodiment shown in FIG. 3, two posts 15 are placed on both sides of and at the same distance from the movable contact 14. In the embodiment shown in FIG. 4, three posts 15 are arranged in triangular fashion around and at the same distance from the movable contact 14. The present invention is not limited to these embodiments but may comprise cases wherein only one post is provided near the movable contact or four or more posts are provided around the movable contact 14. What is important is to provide a support point or points in the neighborhood of the movable contact 14 to prevent skewing of the main body 10 of the switch. Reference numeral 16 denotes a printed circuit board or substrate having a fixed contact 17 mounted thereon.

The main member 10 of the switch has its skirt portion 12 secured to the substrate 16 so that the movable contact 14 is disposed above the fixed contacts 17.

The pushbutton switch operates as follows. When the pushbutton portion 11 of the main member 10 is pressed from above, the pushbutton portion 11 is moved down through deformation of the connecting portion 13 until the movable contact 14 is pressed against the fixed contact 17. The posts 15 adjacent to the movable contact 14 may then be pressed against the substrate 16 owing to the resiliency of the movable contact. The pushbutton portion 11 is now supported at least two points so that tilting of the movable contact 14 may be reliably prevented. When finger pressure is applied to the pushbutton portion 11 diagonally, the entire pushbutton portion 11 is subject to both horizontal and vertical force components and moved downwardly while shifting to the left in FIG. 3 under the resilient deformation of the skirt portion 13. The posts 15 then contact the substrate 16 at substantially the same time that the movable contact 14 is brought into abutting contact with the fixed contact 17. Since the posts 15 are in frictional contact with the substrate 16, the contact 14 will not shift horizontally along the substrate 16. Moreover, the movable contact 14 in contact with the fixed contact 17 will not tilt, by virtue of the supporting action of the posts 15. Assuming that finger pressure has been applied to the peripheral zone of the pushbutton portion 11, tilting of the movable contact 14 will likewise be prevented by the supporting action of the posts 15. It should be obvious from the foregoing description that at least three or more posts 15 may be provided equiangularly around the movable contact 14 to positively eliminate omnidirectional displacement as well as tilting of the movable contact 14.

The pushbutton switch of the present invention provides the following advantages.

Since the posts abut against the substrate at the same time that the movable contact is pressed against the fixed contact, the movable contact is not tilted with respect to the substrate, thereby resulting in a stable electrical connection. In cases where the pushbutton portion has been pressed obliquely or near an end zone thereof, both the horizontal shifting as well as the tilting of the movable contact is inhibited by the posts 14 so that the risk of contact chattering or insufficient electrical connection may be minimized. In addition, the posts operate to correct for switch tilt and displace the contact in the normal direction so that the risk of the switch engaging with the switch housing, and the consequent occurrence of an input error, can be eliminated.

As many apparently widely different embodiments of the present invention can be made without departing from the spirit and scope thereof, it is to be understood that the invention is not limited to the specific embodiments thereof except as defined in the appended claims.

What is claimed is:

1. A pushbutton switch in which a movable contact carried on a deformable support member may be contacted with or separated from an opposing fixed contact for closure or opening of the contacts, said pushbutton switch comprising a base portion having a flat upper surface mounting said fixed contact, a pushbutton member having a flat bottom surface mounting said movable contact, a skirt portion of resilient insulating material coupling said pushbutton member to said base portion and being of sufficient height to position said pushbutton member in an open position in which said movable contact is spaced above said fixed contact and in registry therewith, whereby upon manual depression of said pushbutton member, the resilient skirt portion deforms to permit lowering of said pushbutton member to a closed position in which said movable contact engages said fixed contact, said pushbutton member being relatively rigid, whereby said pushbutton member is subject to tilting when manually depressed in a centrally-offset region, and at least one post depending from the flat bottom surface of said pushbutton member and being spaced from and proximate to said movable contact, said post being of lesser height than the thickness of said movable contact and being spaced above said base portion upper surface in the open position of said pushbutton member, said post being made of a material having a high coefficient of friction and being positioned to engage the flat upper surface of said base portion when said pushbutton member is moved to its closed position, whereby to prevent tilting of said pushbutton member relative to said base portion and to retard transverse shifting of said pushbutton member relative to said base portion.

2. A pushbutton switch according to claim 1 in which said post is made of rubber.

3. A pushbutton switch according to claim 1 in which said movable contact is located centrally on the flat bottom surface of said pushbutton portion, and said pushbutton switch includes two depending posts depending from the bottom surface of said pushbutton portion on opposite sides of said movable contact at equal distances therefrom.

4. A pushbutton switch according to claim 1 in which said movable contact is located centrally on the flat bottom surface of said pushbutton portion, and said pushbutton switch includes three depending posts depending from the bottom surface of said pushbutton portion and arranged around said movable contact at equal distances therefrom.

5. A pushbutton switch according to claim 4 in which said posts are arranged in a triangular pattern around said movable contact.

* * * * *